US005833724A

United States Patent [19]

Wei et al.

[11] Patent Number: 5,833,724

[45] Date of Patent: Nov. 10, 1998

[54] STRUCTURED ABRASIVES WITH ADHERED FUNCTIONAL POWDERS

[75] Inventors: Paul Wei, Amherst; Gwo Shin Swei, East Amherst; Wenliang Patrick Yang, Ballston Lake; Kevin Bruce Allen, Latham, all of N.Y.

[73] Assignee: Norton Company, Worcester, Mass.

[21] Appl. No.: 927,611

[22] Filed: Sep. 11, 1997

Related U.S. Application Data

[63] Continuation-in-part of Ser. No. 892,494, Jul. 14, 1997, which is a continuation of Ser. No. 782,013, Jan. 7, 1997, abandoned.

[51] Int. Cl.[6] ..... B24D 3/34

[52] U.S. Cl. ..... 51/307; 51/295; 51/308; 51/309

[58] Field of Search ..... 51/293, 297, 307–309, 51/295

[56] References Cited

U.S. PATENT DOCUMENTS

| | | | |
|---|---|---|---|
| 2,252,683 | 8/1941 | Albertson | 51/298 |
| 2,292,261 | 8/1942 | Albertson | 51/298 |
| 5,014,468 | 5/1991 | Ravipati et al. | 51/296 |
| 5,090,968 | 2/1992 | Pellow | 51/293 |
| 5,152,917 | 10/1992 | Pieper et al. | 51/309 |
| 5,304,223 | 4/1994 | Peiper et al. | 51/293 |

FOREIGN PATENT DOCUMENTS

| | | |
|---|---|---|
| 2-83172 | 3/1992 | Japan . |
| 4-159084 | 6/1992 | Japan . |

*Primary Examiner*—Deborah Jones
*Attorney, Agent, or Firm*—David Bennett

[57] ABSTRACT

Coated abrasives suitable for very fine abrading applications can be obtained by depositing a layer of a formulation comprising abrasive grits, fillers, grinding aid, additives and a binder resin on a substrate in the form of a structured abrasive and then adhering to the surface of the structured abrasive a functional powder.

18 Claims, No Drawings

STRUCTURED ABRASIVES WITH ADHERED FUNCTIONAL POWDERS

This application is a continuation-in-part of application Ser. No. 08/892,494 filed Jul. 14, 1997 which is a continuation of 08/782,013 filed on Jan. 7, 1997 now abandoned.

BACKGROUND OF THE INVENTION

This invention relates to the production of structure abrasives on substrates in a form useful for fine finishing of substrates such as metals, wood, plastics and glass.

The proposal to deposit generally isolated structures such as islands or ridges of a mixture of a binder and abrasive material on a backing material to form so-called "structured abrasives", has been known for many years. If the islands or ridges have very similar heights above the backing and are adequately separated then, (perhaps after a minor dressing operation), use of the product will result in reduced surface scratching and improved surface smoothness. In addition the spaces between the islands provide a route by which swarf generated by the abrasion can be dispersed from the work area and coolant can circulate.

In a conventional coated abrasive, investigation of the grinding surface reveals that a comparatively small number of the surface abrasive grits in an active abrading zone are in contact with the workpiece at the same time. As the surface wears, this number increases but equally the utility of some of those abrasive grits may be reduced by dulling. The use of structured abrasives has the advantage that the uniform islands wear at essentially the same rate such that a uniform rate of abrasion can be maintained for longer periods. In a sense the abrading work is more evenly shared among a larger number of grinding points. Moreover since the islands comprise many smaller particles of abrasive, erosion of an island uncovers new, unused abrasive particles which are as yet undulled.

One technique for forming such an array of isolated islands or dots that has been described is that of the rotogravure printing. The technique of rotogravure printing employs a roll into the surface of which a pattern of cells has been engraved. The cells are filled with the formulation and the roll is pressed against a surface and the formulation in the cells is transferred to the surface.

In U.S. Pat. No. 5,014,468 a technique for producing structured abrasives is described. In the process a binder/abrasive formulation is deposited from rotogravure cells on a roller in such a way that the formulation is laid down in a series of structures surrounding an area devoid of abrasive. This is believed to be the result of depositing less than the full volume of the cell and only from the perimeter of each cell, which would leave the ring formations described.

The problem with the rotogravure approach has therefore always been the retention of a useful shape to the island. To formulate an abrasive/binder mixture that is sufficiently flowable to be deposited and yet sufficiently non-flowable such that it does not slump to an essentially uniform layer coating when deposited on a substrate has proved very difficult.

Chasman et al., in U.S. Pat. No. 4,773,920 disclosed that using a rotogravure coater, it is possible to apply a uniform pattern of ridges and valleys to the binder composition which, when cured, can serve as channels for the removal of lubricant and swarf. However beyond the bare statement of possibility, no details are given that might teach how this might be carried out.

In U.S. Pat. No. 4,644,703 Kaczmarek et al. used a rotogravure roll in a more conventional fashion to deposit an abrasive/binder formulation to deposit a layer that is then smoothed out before a second layer is deposited by a rotogravure process on top of the smoothed-out first layer. There is no teaching of the nature of the final cured surface.

In U.S. Pat. No. 5,014,468 (Ravipati et al.) it was proposed to use an abrasive/binder mixture having non-Newtonian flow properties and to deposit this mixture by a rotogravure technique on to a film. In this process the mixture was deposited from the edges of the rotogravure cells to produce a unique structures with deposits of reducing thickness with distance away from the surface surrounding areas devoid of the mixture. If the cells are sufficiently close together, the surface structures can appear interlinked. This product has proved very useful, particularly in ophthalmic fining operations. The process is very useful but it has a potential problem with increasing build-up of material in the cells of the rotogravure roll such that the deposition pattern can change slightly during a protracted production run. In addition the nature of the process is such that it is limited to formulations containing relatively fine abrasive grits, (usually less than 20 microns).

Another approach to maling structured abrasives is provided by depositing an abrasive/binder mixture on a substrate surface and then imposing a pattern comprising an array of isolated structures on the mixture by curing the binder while in contact with a mold having the inverse of the desired patterned surface. This approach is described in U.S. Pat. Nos. 5,437,754; 5,378,251; 5,304,223 and 5,152,917. There are several variations on this theme but all have the common feature that each structure in the pattern is set by curing the binder while the composite is in contact with a molding surface.

The present invention presents a technique for producing structured abrasives with particularly attractive options leading to more aggressive abrasion that are well adapted to the treatment of a wide range of substrates while being adapted to yield fine finishes for protracted periods of operation at a substantially uniform cut rate.

GENERAL DESCRIPTION OF THE INVENTION

It has now been found that a structured abrasive having a functional powder adhered to the surface provides a wide range of advantages over the structured abrasive alone.

In the present application the term "functional powder" is used to refer to finely divided material that modifies the abrasive qualities of the structured abrasives to which it is applied. This can be as simple as making the structured abrasive cut more aggressively or reducing the buildup of swarf or static charge on the surface. Some functional powders can additionally serve as a releasing agent or a barrier between the resin formulation and the embossing tool, reducing sticking problems and allowing improved release. Included under the heading of "functional powders" are fine abrasive grits, grinding aids, anti-static additives, lubricant powders and the like. By "finely divided" we mean that the individual particles of the powder have an average particle size, ($D_{50}$), less than about 250 micrometers such as from 1 to 150 micrometers and more preferably from 10 to 100 micrometers.

The present invention also comprises a process for the production of a structured abrasive comprising a pattern of abrasive/binder composites adhered to a backing material said process comprising:

(a) depositing a slurry formulation comprising abrasive grits (and optionally fillers, grinding aids, and other additives), and a curable resin binder on a substrate in a continuous or patterned manner, (b) imposing a pattern on the slurry formulation to form a structured abrasive; and (c) adhering a coating of a functional powder to the patterned surface of the structured abrasive.

The key to this process is the adhesion of the functional powder to the surface of the structured abrasive. This can be achieved by application of the powder to the surface of the structured abrasive before cure of the binder has been completed and the binder is still in a state in which a powder applied thereto will become permanently attached when cure is completed. Alternatively an adhesive coating can be applied to the surface of a fully cured structured abrasive to provide a means of adhering a functional powder to the surface of the structured abrasive.

The powder can be applied in the form of a single layer on top of the abrasive/binder composite or in several layers with intermediate layers of adhesive to retain the powders in position. For example one layer could be a fine abrasive powder and the second a grinding aid.

The powder itself can be an abrasive or a variety of powdered materials, or a combination of the previous, conferring advantageous properties. Abrasive grains usable as the functional powder can consist of any type of abrasive grain and grit size which in some instances may differ from that of the grain used in the adhesive formulation and can lead to unique grinding characteristics. The functional powder can also consist of any of the family of grinding aids, antistatic additives, any class of fillers, and lubricants.

The deposition of the functional powder layer(s) can be done using a variety of conventional deposition methods. These methods include gravity coating, electrostatic coatings, spraying, vibratory coatings, etc. The deposition of varying powders can occur simultaneously or in an ordered fashion to create a composite structure before embossing. The adhesive, where one is used, can be of the same or different type as is present in the abrasive/binder formulation.

DETAILED DESCRIPTION OF THE INVENTION

The formation of the structured abrasive surface can be any of those known in the art in which a slurry composite of abrasive and a binder precursor is cured while in contact with a backing and a production tool so as to be adhered on one surface to the backing and, to have imposed on the other surface the precise shape of the inside surface of the production tool. Such a process is described for example in U.S. Pat. Nos. 5,152,917; 5,304,223; 5,378,251; and 5,437,254 all of which are incorporated herein by reference. Alternative formation methods, including rotogravure coating, are described in U.S. Pat. Nos. 5,014,468 and 4,773,920 and these too are incorporated by reference in this Application.

The surface of the structured abrasive can have any desired pattern and this is determined in large part by the intended purpose of the coated abrasive product. It is for example possible to provide that the surface is formed with alternating ridges and valleys oriented in any desired direction. Alternatively the surface may be provided with a plurality of projecting composite shapes which may be separated or interconnected and either identical or different from adjacent shapes. Most typically the structure abrasives have substantially identical shapes in predetermined patterns across the surface of the coated abrasive. Such shapes may be in the form of pyramids with square or triangular bases or they may have more rounded shapes without clear edges where adjacent planes meet. The rounded shapes may be circular in cross-section or be elongated depending on the conditions of deposition and the intended use. The regularity of the shapes depends to some extent on the intended application. More closely spaced shapes, for example more than about 1000 per square centimeter, are favored for fine finishing or polishing while more aggressive cutting is favored by more widely spaced shapes.

The abrasive component of the formulation can be any of the available materials known in the art such as alpha alumina, (fused or sintered ceramic), silicon carbide, fused alumina/zirconia, cubic boron nitride, diamond and the like as well as the combination of thereof. Abrasive particles useful in the invention typically and preferably have an average particle size from 1 to 150 micron, and more preferably from 1 to 80 micron. In general however the amount of abrasive present provides from about 10 to about 90%, and preferably from about 30 to about 80%, of the weight of the formulation.

The other major component of the formulation is the binder. This is a curable resin formulation selected from radiation curable resins, such as those curable using electron beam, UV radiation or visible light, such as acrylated oligomers of acrylated epoxy resins, acrylated urethanes and polyester acrylates and acrylated monomers including monoacrylated, multiacrylated monomers, and thermally curable resins such as phenolic resins, urea/formaldehyde resins and epoxy resins, as well as mixtures of such resins. Indeed it is often convenient to have a radiation curable component present in the formulation that can be cured relatively quickly after the formulation has been deposited so as to add to the stability of the deposited shape. In the context of this application it is understood that the term "radiation curable" embraces the use of visible light, ultraviolet (UV) light and electron beam radiation as the agent bringing about the cure. In some cases the thermal cure functions and the radiation cure functions can be provided by different functionalities in the same molecule. This is often a desirable expedient.

The resin binder formulation can also comprise a non-reactive thermoplastic resin which can enhance the self-sharpening characteristics of the deposited abrasive composites by enhancing the erodability. Examples of such thermoplastic resin include polypropylene glycol, polyethylene glycol, and polyoxypropylene-polyoxyethylene block copolymer, etc.

Fillers can be incorporated into the abrasive slurry formulation to modify the rheology of formulation and the hardness and toughness of the cured binders. Examples of useful fillers include: metal carbonates such as calcium carbonate, sodium carbonate; silicas such as quartz, glass beads, glass bubbles; silicates such as talc, clays, calcium metasilicate; metal sulfate such as barium sulfate, calcium sulfate, aluminum sulfate; metal oxides such as calcium oxide, aluminum oxide; and aluminum trihydrate.

The abrasive slurry formulation from which the structured abrasive is formed can also comprise a grinding aid to increase the grinding efficiency and cut rate. Useful grinding aid can be inorganic based, such as halide salts, for example sodium cryolite, potassium tetrafluoroborate, etc.; or organic based, such as chlorinated waxes, for example polyvinyl chloride. The preferred grinding aids in this formulation are cryolite and potassium tetrafluoroborate with particle size ranging from 1 to 80 micron, and most preferably from 5 to 30 micron. The weight percent of grinding aid ranges from 0 to 50%, and most preferably from 10–30%.

The abrasive/binder slurry formulations used in the practice of this invention may further comprise additives including: coupling agents, such as silane coupling agents, for example A-174 and A-1100 available from Osi Specialties, Inc., organotitanates and zircoaluminates; anti-static agents, such as graphite, carbon black, and the like; suspending agents, viscosity modifiers such as fumed silica, for example Cab-O-Sil M5, Aerosil 200; anti-loading agents, such as zinc stearate; lubricants such as wax; wetting agents; dyes; fillers; viscosity modifiers; dispersants; and defoamers.

Depending on the application, the functional powder deposited on the slurry surface can impart unique grinding characteristics to the abrasive products. Examples of functional powders include: 1) abrasive grains—all types and grit sizes; 2) fillers—calcium carbonate, clay, silica, wollastonite, aluminum trihydrate, etc.; 3) grinding aids—$KBF_4$, cryolite, halide salt, halogenated hydrocarbons, etc.; 4) anti-loading agents—zinc stearate, calcium stearate, etc., 5) anti-static agents—carbon black, graphite, etc., 6) lubricants—waxes, PTFE powder, polyethylene glycol, polypropylene glycol, polysiloxanes etc.

The backing material upon which the formulation is deposited can be a fabric, (woven, non-woven or fleeced), paper, plastic film or metal foil. Generally, the products made according to the present invention find their greatest utility in producing fine grinding materials and hence a very smooth surface is preferred. Thus finely calendered paper, plastic film or a fabric with a smooth surface coating is usually the preferred substrate for deposition of the composite formulations according to the invention.

The invention will be further described with respect to certain specific embodiments which are understood to be for the purposes of illustration only and imply no necessary limitation on the scope of the invention.

Abbreviations

To simplify data presentation, the following abbreviations will be used:

Polymer Components

Ebecryl 3605, 3700—acrylated epoxy oligomers available from UCB Radcure Chemical Corp.

TMPTA—trimethylol propane triacrylate available from Sartomer Company, Inc.

ICTA—isocyanurate triacrylate available from Sartomer Co., Inc.

TRPGDA—tripropylene glycol diacrylate available from Sartomer Co., Inc.

Binder Components

Darocure 1173—a photoinitiator available from Ciba-Geigy Company

Irgacure 651—a photoinitiator available from Ciba-Geigy Company

2-Methylimidazole—a catalyst from the BASF Corp.

Pluronic 25R2—polyoxypropylene-polyoxyethylene block copolymer available from the BASF Corp.

$KBF_4$—grinding aid with a median particle size of approximately 20 $\mu$m available from Solvay.

Cab-O-Sil M5—fumed silica from Cabot Corporation

Grain

FRPL—fused $Al_2O_3$ from Treibacher (P320 or P1000: grade indicated by "P-number").

Calcined $Al_2O_3$ (40 $\mu$m) from Microabrasives Corporation.

Backings 3 mil Mylar film for ophthalmic applications 5 mil Mylar film for metalworking applications Surlyn-coated J-weight polyester cloth * Surlyn is an ionomer resin SURLYN 1652-1 from Du Pont.

Abrasive Slurry Formulations

TABLE I

| Component | I | II | III | IV |
|---|---|---|---|---|
| Ebecryl 3605 | 19.3% | | | |
| Ebecryl 3700 | | 6.3% | | |
| NVP | 8.3% | | | |
| ICTA | | 7.9% | 14.7% | 14% |
| TMPTA | | 8.1% | 14.7% | 14% |
| TRPGDA | | 5.3% | | |
| Irgacure 651 | | 0.8% | | |
| Darocure 1173 | 1.1% | | 0.6% | 0.6% |
| 2 MI | 0.2% | | | |
| Cab-O-Sil | | 0.8% | | |
| Silane | 1.1% | 0.8% | | |
| Pluronic 25R2 | | | | 1.4% |
| $KBF_4$ | 23.3% | 23.3% | 23.3% | 23.3% |
| Grain | 46.7% | 46.7% | 46.7% | 46.7% |

Formulation Preparation Procedure

The monomers and/or oligomer components were mixed together for 5 minutes using a high shear mixer at 1000 rpm. This binder formulation was then mixed with any initiators, wetting agents, defoaming agents, dispersants etc. and mixing was continued for 5 minutes further at the same rate of stirring. Then the following components were added, slowly and in the indicated order, with five minutes stirring at 1500 rpm between additions: suspension agents, grinding aids, fillers and abrasive grain. After addition of the abrasive grain the speed of stirring was increased to 2,000 rpm and continued for 15 minutes. During this time the temperature was carefully monitored and the stirring rate was reduced to 1,000 rpm if the temperature reached 40.6° C.

Deposition of the Formulation

The resin formulation was coated on to a variety of conventional substrates listed previously. In the cited cases the abrasive slurry was applied using a knife coating with the gap set at desired values. Coating was done at room temperatures.

Application of Functional Powders and Embossing

Before embossing, the surface layer of the slurry was modified with abrasive grits with the same particle size or finer than that used in the formulation. Enough was deposited to form a single layer adhered by the uncured binder component. Excess powder was removed from the layer by vibration. Application of the powder was by a conventional, vibratory screening method.

Once the substrate had been coated with the uncured slurry formulation and the functional powder applied, an embossing tool with the desired pattern was used to impart the desired shape to the abrasive resin and grain formulation. This embossing setup included a steel backing roll which imparted the necessary support during the application of pressure by the steel embossing roll. A wire brush setup was used to remove any dry residue or loose grains remaining in the cells after the tool had imparted its impression on to the viscosity modified formulation.

Cure

After the pattern was embossed into the viscosity-modified layer, the substrate was removed from the embossing tooling and passed to a curing station. Where the cure is thermal, appropriate means are provided. Where the cure is activated by photoinitiators, a radiation source can be provided. If UV cure is employed, two 300 watt sources are used: a D bulb and an H bulb with the dosage controlled by the rate at which the patterned substrate passed under the sources. In the case of the matrix of experiments listed in Table 2, the cure was by UV light. In the case of the Formulation I, however, UV cure was immediately followed by a thermal cure. This curing process was adequate to ensure final dimensional stability.

In the first example, the layer was embossed by a roll having cells engraved therein in a 17 Hexagonal pattern. This produced the pattern of hexagonal shaped islands shown in FIGS. 1 and 2. In each, an abrasive grit was dusted on the surface to serve as the functional powder. In FIG. 1 the abrasive dusted on the surface was P1000 and in FIG. 2 it was P320. In each case the abrasive/binder formulation was Formulation I.

In the second example the embossing roll was engraved with a 25 Tri-helical roll surface pattern of grooves. FIGS. 3 and 4 show formulations III and IV as is used in the first experiment coated with P320 and P1000 abrasive grits respectively. The same coating technique was used.

In a third example the pattern engraved on the embossing roll was 45 Pyramid with formulation I giving a pattern of isolated square-based pyramids. The surface was modified by application of P1000 grit over the same formulation used in the first and second experiments. The result is shown in FIG. 5.

In all three experiments the structures on the embossed surface remained essentially unchanged from the time of the embossing to the time the binder component was fully cured.

Additional examples, similar in shape but varying in formulation and abrasive content were also carried out as listed in Table 2. In all cases, the manufacturing process is identical to the first three examples; however, variations were made in the resin composition and functional powders.

The 17 Hexagonal embossing roll pattern comprised cells 559 microns in depth with equal sides of 1000 microns at the top and 100 microns at the bottom.

The 25 Tri-helical pattern comprised of a continuous channel cut at 45 degrees to the roll axis that has a depth of 508 microns and top opening width of 750 microns.

The 40 Tri-helical pattern comprised of a continuous channel cut at 45 degrees to the roll axis that has a depth of 335 microns and a top opening width of 425 microns.

The 45 Pyramidal pattern comprised a square-based, inverted pyramid shaped cells with a depth of 221 microns and a side dimension of 425 microns.

Grinding Tests

Several of the listed samples were subjected to two primary forms of grinding testing with the data listed in Tables 3–5. The first form of testing consisted of Schieffer testing up to 600 revolutions with an 8 lbs. of constant load on a hollow, 304 stainless steel workpiece with a 1.1 inch O.D. which gives a effective grinding pressure of 23.2 psi. The patterned abrasive was cut into disks of 4.5" diameter and mounted to a steel backing plate. Both the backing plate and the workpiece rotate in a clockwise fashion with the backing plate rotating at 195 RPM and the workpiece rotating at 200 RPM. Workpiece weight loss was noted every 50 revolutions and totaled at the end of 600 revolutions.

The second method of testing consisted of a microabrasive ring testing. In this test, nodular cast iron rings (1.75 inch O.D., 1 inch I.D. and 1 inch width), were pre-roughened using a 60 $\mu$m conventional film product and then ground at 60 psi. with the patterned abrasive. The abrasive was first sectioned into 1" width strips and was held against the workpiece by rubber shoes. The workpiece was rotated at 100 RPM and oscillated in the perpendicular direction at a rate of 125 oscillations/minute. All grinding was done in a lubricated bath of OH200 straight oil. Weight loss was recorded every 10 revolutions and totaled at the end of the test.

TABLE 2

| Example | Embossed Pattern | Lines/Inch | Resin Formulation | Slurry Thickness (mils) | Grain in Slurry | Functional Powder |
|---|---|---|---|---|---|---|
| 1 | Hexagonal | 17 | I | 5 | P320 | P1000 |
| 2 | Hexagonal | 17 | I | 8 | P320 | P1000 |
| 3 | Hexagonal | 17 | I | 10 | P320 | P1000 |
| 4 | Hexagonal | 17 | I | 10 | P320 | P320 |
| 5 | Tri-Helical | 25 | II | 7 | P320 | P320 |
| 6 | Tri-Helical | 25 | I | 7 | P320 | P320 |
| 7 | Tri-Helical | 25 | I | 7 | P320 | P1000 |
| 3 | Tri-Helical | 25 | III | 7 | P320 | P320 |
| 9 | Tri-Helical | 25 | III | 7 | P320 | P320 + $KBF_4$ |
| 10 | Tri-Helical | 25 | III | 7 | 40 $\mu$m | 40 $\mu$m |
| 11 | Tri-Helical | 25 | IV | 7 | 40 $\mu$m | 40 $\mu$m |
| 12 | Tri-Helical | 40 | III | 5 | P320 | P320 + $KBF_4$ |
| 13 | Tri-Helical | 40 | III | 5 | 40 $\mu$m | 40 $\mu$m |
| 14 | Tri-Helical | 40 | IV | 5 | 40 $\mu$m | 40 $\mu$m |
| 15 | Pyramidal | 45 | I | 5 | P320 | P1200 |
| 16 | Pyramidal | 45 | I | 7 | P320 | P1200 |
| 17 | Pyramidal | 45 | I | 7 | P320 | P320 |
| 18 | Pyramidal | 45 | I | 10 | P320 | P1000 |

TABLE 3

Schieffer Testing of Patterned Abrasives with FRPL P320 grain in Slurry Formulation. (500 Revolutions)

| Example | Pattern | Grain in Slurry | Functional Powder | Total Cut (% of Control) |
|---|---|---|---|---|
| 18 | 45 Pyramid (Control) | P320 | P1000 | 100% |
| 3 | 17 Hexagonal | P320 | P1000 | 104% |
| 4 | 17 Hexagonal | P320 | P320 | 113% |
| 8 | 25 Tri-Helical | P320 | P320 | 115% |
| 9 | 25 Tri-Helical | P320 | P320 + $KBF_4$ | 143% |

TABLE 4

Schieffer Testing of Patterned Abrasives with Calcined $Al_2O_3$ 40 $\mu$m Grains in Slurry Formulation. (600 Revolutions)

| Example | Pattern | Grain in Slurry | Functional Powder | Total Cut (% of Control) |
|---|---|---|---|---|
| C-1 (Control) | None | N/A | N/A | 100% |
| 10 | 25 Tri-Helical | 40 $\mu$m | 40 $\mu$m | 131% |
| 13 | 40 Tri-Helical | 40 $\mu$m | 40 $\mu$m | 110% |

TABLE 5

Ring Testing for Microfinishing Applications (50 Revolutions at 60 psi.)

| Example | Pattern | Grain in Slurry | Functional Powder | Total Cut (% of Control) |
|---|---|---|---|---|
| C-1 (Control) | None | N/A | N/A | 100% |
| 10 | 25 Tri-Helical | 40 $\mu$m | 40 $\mu$m | 109% |

In Table 3, the effect of the type of functional powder and pattern is clearly demonstrated. With the 45 Pyramid (P320 in the formulation and P1000 as the functional powder) as the control, using a larger 17 hexagonal shape pattern the same resin formulation and functional powder resulted in a slight increase in total cut. In all cases where the P1000 was substituted with a coarser P320 grade, the cut was further increased. In addition, the tri-helical pattern outperformed the hexagonal pattern. In the final case where the functional powder consisted of a blend of $KBF_4$ and P320, the cut was dramatically increased. From this set of data it can be clearly seen that the pattern type coupled with the type of functional powder clearly alters the grinding characteristics.

In Table 4, the patterned abrasives were compared to comparative example C-1, a 40 $\mu$m grit conventional microfinishing abrasive under the trade name of Q151 from Norton Co. It can be observed in both patterned abrasives, the total cut was increased significantly over the conventional product with the 25 Tri-helical outperforming the finer 40 Tri-helical pattern.

In Table 5, the 40 $\mu$m patterned abrasives were compared in a microfinishing application. Once again, compared to the comparative example C-1, a conventional abrasive product under the trade name of Q151 from Norton Co., the patterned abrasive demonstrates an improvement in the total cut. Overall, the above patterns performed well in the abrasive testing applications, generating effective abrading from the start.

What is claimed is:

1. A process for the production of an improved structured coated abrasive comprising a pattern of abrasive/binder composites adhered to a backing material, each composite comprising an at least partially cured binder and abrasive particles dispersed therein, said process comprising adhering a functional powder to the surface of such composites by means of a binder and subsequently curing said binder.

2. A process according to claim 1 in which the composites are disposed in a regular array and comprise a partially cured binder such that when the functional powder is applied to the surface of the composites the partially cured binder causes the functional powder to adhere to the surface of the composites, and the cure of the binder is subsequently completed.

3. A process according to claim 1 in which a second binder material is applied over the surface of the abrasive/binder composites and a functional powder is applied over the second binder which is subsequently cured to provide the improved structured coated abrasive.

4. A process according to claim 1 in which the functional powder has an average particle size of 1 to 150 micrometers.

5. A process according to claim 1 in which the functional powder is selected from the group consisting of abrasives, fillers, grinding aids, anti-static powders, stearated powders and mixtures thereof.

6. A process according to claim 1 in which the binder comprises a radiation or thermally curable resin, or a combination thereof.

7. A process according to claim 1 in which the binder component of the composites comprises a non-reactive thermoplastic component.

8. A process according to claim 1 in which the abrasive comprises from about 10 to 90%, of the weight of the abrasive/binder composite.

9. A process according to claim 5 in which the functional powder comprises an abrasive grit selected from the group consisting of ceria, alumina, fused alumina/zirconia, silicon carbide, cubic boron nitride, and diamond.

10. A process according to claim 1 in which the abrasive/binder composite also comprises one or more additives selected from the group consisting of, grinding aids, inert fillers, anti-static agents, lubricants, anti-loading agents and mixtures thereof.

11. A process according to claim 10 in which the abrasive/binder composite comprises a grinding aid selected from the group consisting of cryolite, potassium tetrafluoroborate and mixtures thereof.

12. A process according to claim 3 in which the second binder is the same as the binder used to produce the structured abrasive.

13. A coated abrasive prepared by a process according to claim 1.

14. A coated abrasive prepared by a process according to claim 2.

15. A coated abrasive prepared by a process according to claim 3.

16. A coated abrasive prepared by a process according to claim 4.

17. A coated abrasive prepared by a process according to claim 5.

18. A coated abrasive prepared by a process according to claim 6.

* * * * *